US008055174B2

(12) United States Patent
Yoshikawa

(10) Patent No.: US 8,055,174 B2
(45) Date of Patent: Nov. 8, 2011

(54) FIXING DEVICE USING INDUCTION HEATING AND IMAGE FORMING APPARATUS USING THE FIXING DEVICE

(75) Inventor: Takahiro Yoshikawa, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 402 days.

(21) Appl. No.: 12/292,986

(22) Filed: Dec. 2, 2008

(65) Prior Publication Data

US 2009/0148206 A1 Jun. 11, 2009

(30) Foreign Application Priority Data

Dec. 7, 2007 (JP) ..... 2007-316554

(51) Int. Cl.
*G03G 15/20* (2006.01)

(52) U.S. Cl. ..... 399/329

(58) Field of Classification Search ..... 399/69, 399/70, 328, 329, 330, 331
See application file for complete search history.

(56) References Cited

U.S. PATENT DOCUMENTS

| | | | | |
|---|---|---|---|---|
| 4,743,940 | A * | 5/1988 | Nagasaka et al. | 399/330 |
| 5,402,211 | A | 3/1995 | Yoshikawa | |
| 5,850,588 | A | 12/1998 | Yoshikawa | |
| 6,160,974 | A | 12/2000 | Yoshikawa et al. | |
| 6,501,914 | B2 | 12/2002 | Yoshikawa | |
| 6,757,502 | B2 | 6/2004 | Yoshikawa | |
| 6,795,680 | B2 * | 9/2004 | Yokoi et al. | 399/333 |
| 6,823,149 | B2 | 11/2004 | Yoshikawa et al. | |
| 7,043,185 | B2 | 5/2006 | Yoshikawa | |
| 7,127,204 | B2 | 10/2006 | Satoh et al. | |
| 7,174,124 | B2 | 2/2007 | Ishibashi et al. | |
| 7,292,801 | B2 | 11/2007 | Yoshikawa | |
| 7,313,353 | B2 | 12/2007 | Satoh et al. | |
| 7,366,456 | B2 | 4/2008 | Yoshikawa | |
| 2002/0031358 | A1 | 3/2002 | Yoshikawa | |
| 2003/0103789 | A1 | 6/2003 | Boss | |
| 2003/0161649 | A1 | 8/2003 | Yoshikawa et al. | |
| 2003/0231893 | A1 | 12/2003 | Yoshikawa | |
| 2004/0086285 | A1 | 5/2004 | Yoshikawa | |
| 2004/0109709 | A1 | 6/2004 | Ishibashi et al. | |
| 2004/0264991 | A1 | 12/2004 | Yoshikawa | |

(Continued)

FOREIGN PATENT DOCUMENTS

JP 2003-084597 3/2003

(Continued)

OTHER PUBLICATIONS

Abstract of JP 11-194661 published Jul. 21, 1999.

(Continued)

*Primary Examiner* — Sandra Brase
(74) *Attorney, Agent, or Firm* — Harness, Dickey & Pierce, P.L.C.

(57) ABSTRACT

In a fixing device for fixing a toner image on a recording medium, a fixing roller and a heating roller support a fixing belt. A pressing roller presses against the fixing roller via the fixing belt to form a fixing nip between the fixing belt and the pressing roller. A tension roller presses against the fixing belt to apply tension to the fixing belt. A primary heat source heats the fixing belt, and is disposed along an outer face of the fixing belt opposite the heating roller. A secondary heat source is provided inside the tension roller to supply deficient heat not provided by the primary heat source.

20 Claims, 8 Drawing Sheets

U.S. PATENT DOCUMENTS

| | | | | |
|---|---|---|---|---|
| 2005/0047838 | A1* | 3/2005 | Uehara et al. | 399/329 |
| 2005/0163543 | A1 | 7/2005 | Satoh et al. | |
| 2005/0191098 | A1 | 9/2005 | Ueno et al. | |
| 2006/0013607 | A1 | 1/2006 | Yoshikawa | |
| 2006/0051121 | A1* | 3/2006 | Matsusaka et al. | 399/70 |
| 2006/0171731 | A1 | 8/2006 | Yoshikawa | |
| 2006/0204265 | A1 | 9/2006 | Yoshikawa | |
| 2007/0000899 | A1 | 1/2007 | Tsunoda | |
| 2007/0014603 | A1 | 1/2007 | Satoh et al. | |
| 2007/0048042 | A1* | 3/2007 | Uehara et al. | 399/329 |
| 2007/0059020 | A1 | 3/2007 | Yoshikawa | |
| 2007/0065189 | A1* | 3/2007 | Miyata et al. | 399/329 X |
| 2007/0092277 | A1 | 4/2007 | Miyata et al. | |
| 2007/0166084 | A1* | 7/2007 | Yoshino et al. | 399/329 |
| 2007/0172272 | A1* | 7/2007 | Miyata et al. | 399/329 |
| 2007/0264060 | A1* | 11/2007 | Ueno et al. | 399/330 |
| 2007/0274748 | A1 | 11/2007 | Yoshikawa | |
| 2008/0031647 | A1 | 2/2008 | Yoshikawa | |
| 2008/0101814 | A1 | 5/2008 | Yoshikawa | |
| 2009/0052927 | A1 | 2/2009 | Yoshikawa | |

FOREIGN PATENT DOCUMENTS

| | | |
|---|---|---|
| JP | 2005-017564 | 1/2005 |
| JP | 3711764 | 8/2005 |
| JP | 2005-258383 | 9/2005 |

OTHER PUBLICATIONS

European Search Report dated Apr. 2, 2009 for corresponding European Application No. 08169990.2.

* cited by examiner

FIXING DEVICE USING INDUCTION HEATING AND IMAGE FORMING APPARATUS USING THE FIXING DEVICE

PRIORITY STATEMENT

The present patent application claims priority from Japanese Patent Application No. 2007-316554, filed on Dec. 7, 2007, in the Japan Patent Office, the entire contents of which are hereby incorporated herein by reference.

BACKGROUND OF THE INVENTION

1. Field of the Invention

Example embodiments generally relate to a fixing-device, and more particularly, to a fixing device using induction heating and an image forming apparatus using the fixing device.

2. Description of the Related Art

Related-art image forming apparatuses, such as copiers, printers, facsimile machines, or multifunction printers having at least one of copying, printing, scanning, and facsimile functions, typically form a toner image on a recording medium (e.g., a sheet) based on image data using electrophotography. Thus, for example, a charger charges a surface of an image carrier; an optical writer emits a light beam onto the charged surface of the image carrier to form an electrostatic latent image on the image carrier according to the image data; a development device develops the electrostatic latent image with a developer (e.g., toner) to form a toner image on the image carrier; the toner image is then transferred from the image carrier onto a sheet; and finally, a fixing device applies heat and pressure to the sheet bearing the toner image to fix the toner image on the sheet, thus forming the toner image on the sheet.

In order to save energy, one example of the fixing device includes an induction heater to heat a heating roller or a fixing belt that applies heat to a sheet bearing a toner image to fix the toner image on the sheet. The induction heater provides a higher heat exchange rate than a halogen heater, for example, and thereby decreases a time period needed for the fixing device to heat up to a proper fixing temperature after the fixing device is powered on.

In a high-speed image forming apparatus for forming an image at a high speed, the fixing device is upsized to provide a longer fixing nip at which heat and pressure are applied to a sheet bearing a toner image. The upsized fixing device has a larger heat capacity and thereby uses more heat. Therefore, in order to heat the upsized fixing device up to the proper fixing temperature quickly, power is cut off to devices other than the fixing device included in the image forming apparatus in order to be able to supply more power to the fixing device.

More specifically, the induction heater uses an inverter to generate a high-frequency current, which in turn requires that the inverter needs to be larger to generate more power, and accordingly, the induction heater coil needs to be larger as well. At the same time, however, the maximum electric power consumption available to the image forming apparatus varies depending on the country where it is used. When the image forming apparatus is manufactured to correspond to the largest maximum electric power consumption available for all destination countries, the induction heater is upsized, thus increasing the size of the image forming apparatus overall at a time when market demands favor more compact image forming apparatuses

SUMMARY

At least one embodiment may provide a fixing device that fixes a toner image on a recording medium, and includes an endless fixing belt, a fixing roller, a heating roller, a pressing roller, a tension roller, a primary heat source, and a secondary heat source. The fixing roller supports the fixing belt. The heating roller supports the fixing belt together with the fixing roller. The pressing roller presses against the fixing roller via the fixing belt to form a fixing nip between the fixing belt and the pressing roller. The tension roller presses against the fixing belt to apply tension to the fixing belt. The primary heat source heats the fixing belt and is disposed along an outer face of the fixing belt opposite the heating roller. The secondary heat source is provided inside the tension roller to supply deficient heat not provided by the primary heat source.

At least one embodiment may provide an image forming apparatus that includes an image forming mechanism to form a toner image on a recording medium, and a fixing device to fix the toner image on the recording medium. The fixing device includes an endless fixing belt, a fixing roller, a heating roller, a pressing roller, a tension roller, a primary heat source, and a secondary heat source. The fixing roller supports the fixing belt. The heating roller supports the fixing belt together with the fixing roller. The pressing roller presses against the fixing roller via the fixing belt to form a fixing nip between the fixing belt and the pressing roller. The tension roller presses against the fixing belt to apply tension to the fixing belt. The primary heat source heats the fixing belt and is disposed along an outer face of the fixing belt opposite the heating roller. The secondary heat source is provided inside the tension roller to supply deficient heat not provided by the primary heat source.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
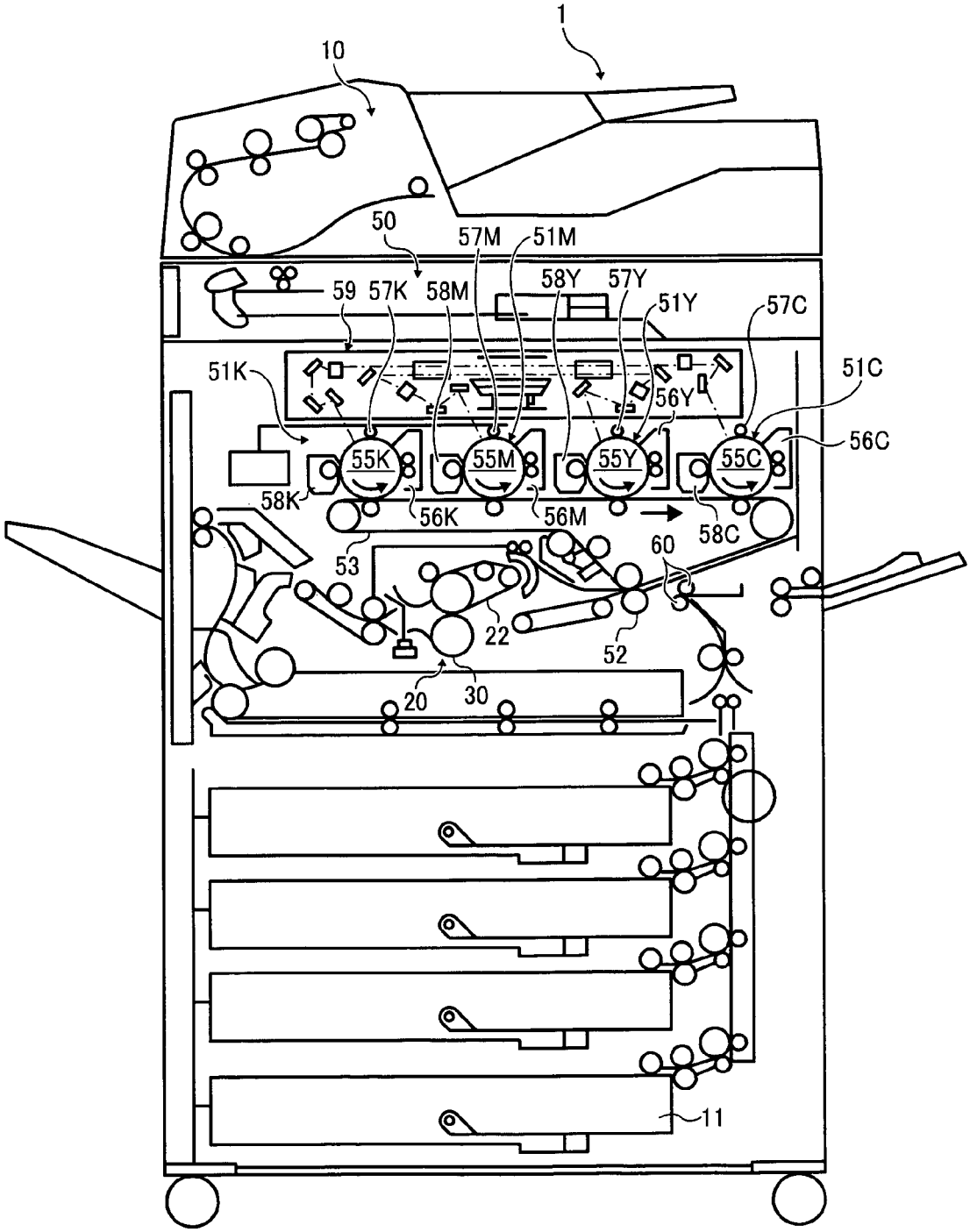
FIG. 1 is a schematic view of an image forming apparatus according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment is explained.

FIG. 1 is a schematic view of the image forming apparatus 1. The image forming apparatus 1 includes an auto document feeder (ADF) 10, a scanner 50, a writer 59, image forming devices 51K, 51M, 51Y, and 51C, an intermediate transfer device 53, a sheet supplier 11, a registration roller pair 60, a second transfer device 52, and/or a fixing device 20. The image forming devices 51K, 51M, 51Y, and 51C include photoconductors 55K, 55M, 55Y, and 55C, chargers 57K, 57M, 57Y, and 57C, development devices 56K, 56M, 56Y, and 56C, and/or cleaners 58K, 58M, 58Y, and 58C, respectively. The fixing device 20 includes a fixing belt 22 and/or a pressing roller 30.

The image forming apparatus 1 can be a copier, a facsimile machine, a printer, a plotter, a multifunction printer having at least one of copying, printing, scanning, plotter, and facsimile functions, or the like. According to this example embodiment, the image forming apparatus 1 functions as a digital copier for forming a full-color image on a recording medium by electrophotography.

The ADF 10 feeds an original document sheet to the scanner 50. The scanner 50 optically reads an image on the original document sheet to generate image data and sends the image data to the writer 59. The photoconductors 55K, 55M, 55Y, and 55C have a drum shape and rotate counterclockwise in FIG. 1. The chargers 57K, 57M, 57Y, and 57C charge surfaces of the photoconductors 55K, 55M, 55Y, and 55C, respectively. The writer 59 emits light beams onto the charged surfaces of the photoconductors 55K, 55M, 55Y, and 55C, according to the image data sent from the scanner 50 or image data sent from an external device to form electrostatic latent images on the surfaces of the photoconductors 55K, 55M, 55Y, and 55C, respectively. The image data includes black, magenta, yellow, and cyan image data, and the writer 59 emits the light beams corresponding to the black, magenta, yellow, and cyan image data, respectively.

The development devices 56K, 56M, 56Y, and 56C adhere toner particles to the electrostatic latent images formed on the photoconductors 55K, 55M, 55Y, and 55C to form black, magenta, yellow, and cyan toner images, respectively. The black, magenta, yellow, and cyan toner images are transferred from the photoconductors 55K, 55M, 55Y, and 55C, respectively, and superimposed on the intermediate transfer device 53 to form a color toner image on the intermediate transfer device 53. The cleaners 58K, 58M, 58Y, and 58C collect residual toner particles not transferred and thereby remaining on the surfaces of the photoconductors 55K, 55M, 55Y, and 55C from the photoconductors 55K, 55M, 55Y, and 55C, respectively.

The sheet supplier 11 feeds a sheet, serving as a recording medium, toward the registration roller pair 60. The registration roller pair 60 performs skew correction on the sheet and feeds the sheet toward the second transfer device 52 at a proper time. The second transfer device 52 transfers the color toner image formed on the intermediate transfer device 53 onto the sheet sent from the registration roller pair 60.

The sheet bearing the color toner image is sent to the fixing device 20 through a conveyance path. In the fixing device 20, the pressing roller 30 pressingly contacts the fixing belt 22 to form a fixing nip between the pressing roller 30 and the fixing belt 22. The fixing belt 22 and the pressing roller 30 nip the sheet bearing the color toner image at the fixing nip and apply heat and pressure, respectively, to the sheet bearing the color toner image, to fix the color toner image on the sheet. The sheet bearing the fixed color toner image is sent from the fixing nip to an outside of the image forming apparatus 1. Thus, a series of image forming process is completed.

Figure 2:
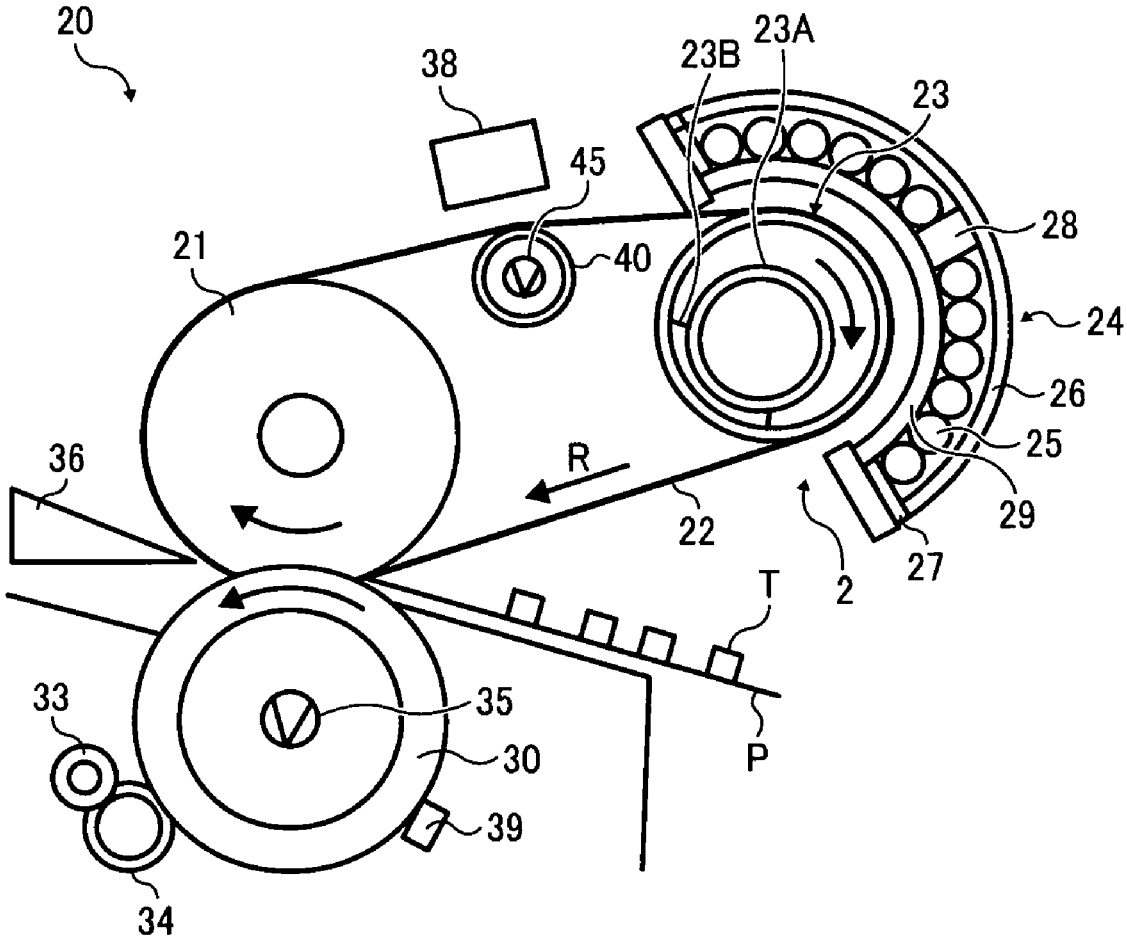
FIG. 2 is a sectional view (according to an example embodiment) of a fixing device included in the image forming apparatus shown in FIG. 1.

Referring to FIG. 2, the following describes a structure and an operation of the fixing device 20. FIG. 2 is a sectional view of the fixing device 20. The fixing device 20 further includes a fixing roller 21, a heating roller 23, an induction heater 2, a tension roller 40, a halogen heater 45, non-contact temperature sensors 28 and 38, an oil application roller 34, a cleaning roller 33, a separation plate 36, a halogen heater 35, and/or a thermistor 39.

The induction heater 2 includes an internal core 23A, shield members 23B, and/or an induction heating portion 24. The induction heating portion 24 includes a coil 25, a core 26, a side core 27, and/or a coil guide 29.

The fixing roller 21 includes an elastic layer serving as a surface layer and including a silicone rubber. The pressing roller 30 presses against an outer circumferential surface of the fixing roller 21 via the fixing belt 22 to form the fixing nip between the pressing roller 30 and the fixing belt 22. A driver rotates the pressing roller 30 counterclockwise in FIG. 2. Accordingly, the fixing roller 21, which presses against the pressing roller 30, rotates clockwise in FIG. 2.

The heating roller 23 includes a non-magnetic material, such as SUS 304, and has a tubular shape. The heating roller 23 rotates clockwise in FIG. 2. The internal core 23A and the shield members 23B are provided inside the heating roller 23. The internal core 23A includes a ferromagnetic material, such as ferrite. The shield members 23B include a low-magnetic-permeability material, such as copper. The internal core 23A opposes the coil 25 of the induction heating portion 24 via the fixing belt 22. The shield members 23B shield both ends of the internal core 23A in an axial direction of the heating roller 23. The internal core 23A rotates in synchronism with the shield members 23B. However, the internal core 23A and the shield members 23B do not rotate in synchronism with the heating roller 23.

The fixing belt 22 is looped over the heating roller 23 and the fixing roller 21. The tension roller 40 contacts and pushes the fixing belt 22 to apply tension to the fixing belt 22. The halogen heater 45, serving as a secondary heat source, is provided inside the tension roller 40. The non-contact temperature sensor 38 detects a temperature of the tension roller 40 via the fixing belt 22. The halogen heater 45 is turned on and off according to the detected temperature of the tension roller 40. The fixing belt 22 has an endless belt shape and has a multilayer structure in which a base layer, including a polyimide resin, a heat generating layer, including silver, nickel, and iron, and a releasing layer, serving as a surface layer and including a fluorine compound, are layered. The releasing layer of the fixing belt 22 releases toner particles from the fixing belt 22. The tension roller 40 has a thin tubular shape having a thickness of about 1 mm or smaller and includes metal, such as aluminum and iron.

The induction heating portion 24 includes the coil 25, a core portion including the core 26 and the side core 27, and the coil guide 29. The internal core 23A is also included in the core portion. The induction heating portion 24 opposes the heating roller 23 via the fixing belt 22. For example, the induction heating portion 24 is disposed along an outer face of the fixing belt 22 opposite the heating roller 23. The coil 25 includes a litz wire formed of bundled thin wires extending in the axial direction of the heating roller 23 to cover a part of the fixing belt 22 looped over the heating roller 23. The coil guide 29 includes a heat-resistant resin material and holds the coil 25, the core 26, and the side core 27. Each of the core 26 and the side core 27 includes a high-magnetic-permeability material, such as ferrite. The core 26 opposes the coil 25 extending in the axial direction of the heating roller 23. The side core 27 is provided on an end of the coil 25.

The core portion of the induction heater 2 indicates cores provided in the induction heating portion 24 and the heating roller 23 and opposing each other to perform induction heating, which are the core 26 and the side core 27 provided in the induction heating portion 24 and the internal core 23A provided in the heating roller 23. When the internal core 23A is provided inside the heating roller 23, a proper magnetic field is generated between the core 26 and internal core 23A to effectively heat the heating roller 23 and the fixing belt 22.

The pressing roller 30 includes a core metal and an elastic layer formed on the core metal and including a fluorocarbon rubber and a silicone rubber. The pressing roller 30 presses the fixing roller 21 via the fixing belt 22. A sheet P is conveyed through the fixing nip formed between the fixing belt 22 and the pressing roller 30.

A guide plate is provided at an entrance of the fixing nip, which is provided upstream from the fixing nip in a sheet conveyance direction, and guides the sheet P to the fixing nip. The separation plate 36 is provided at an exit of the fixing nip, which is provided downstream from the fixing nip in the sheet conveyance direction, and guides and separates the sheet P from the fixing belt 22.

The halogen heater 35 is provided inside the pressing roller 30. The thermistor 39 opposes an outer circumferential surface of the pressing roller 30 and detects a temperature of the pressing roller 30. The halogen heater 35 is turned on and off according to the detected temperature of the pressing roller 30. The oil application roller 34 contacts the outer circumferential surface of the pressing roller 30 to apply oil, such as silicone oil, to the pressing roller 30. The oil applied to the pressing roller 30 is supplied onto the fixing belt 22 to release toner particles from the fixing belt 22. The cleaning roller 33 contacts the oil application roller 34 to clean an outer circumferential surface of the oil application roller 34.

The non-contact temperature sensor 28 opposes the fixing belt 22 and detects a surface temperature, that is, a fixing temperature, of the fixing belt 22 looped over the heating roller 23, so as to control heating by the induction heating portion 24 according to the detected surface temperature of the fixing belt 22.

The following describes an operation of the fixing device 20 having the above-described structure. The rotating pressing roller 30 rotates the fixing belt 22 in a rotating direction R. Accordingly, the heating roller 23 having the tubular shape and the fixing roller 21 rotate clockwise in FIG. 2. The induction heating portion 24 heats the fixing belt 22 at an opposing position at which the induction heating portion 24 opposes the fixing belt 22. For example, when a high-frequency alternating current flows in the coil 25, magnetic lines of force generate between the core 26 and internal core 23A. Directions of the magnetic lines of force alternately switch in opposite directions to generate eddy currents on a surface of the heating roller 23. An electric resistance of the heating roller 23 generates Joule heat. The Joule heat heats the fixing belt 22 looped over the heating roller 23.

When a heated portion on the fixing belt 22 heated by the induction heating portion 24 reaches the fixing nip formed between the fixing belt 22 and the pressing roller 30, the fixing belt 22 and the pressing roller 30 heat and melt a toner image T on a conveyed sheet P. For example, when the sheet P bearing the toner image T formed by the above-described image forming process is guided by the guide plate and enters the fixing nip formed between the fixing belt 22 and the pressing roller 30, the fixing belt 22 and the pressing roller 30 apply heat and pressure, respectively, to the sheet P bearing the toner image T to fix the toner image T on the sheet P. The sheet P bearing the fixed toner image T separates from the fixing nip.

Figure 3:
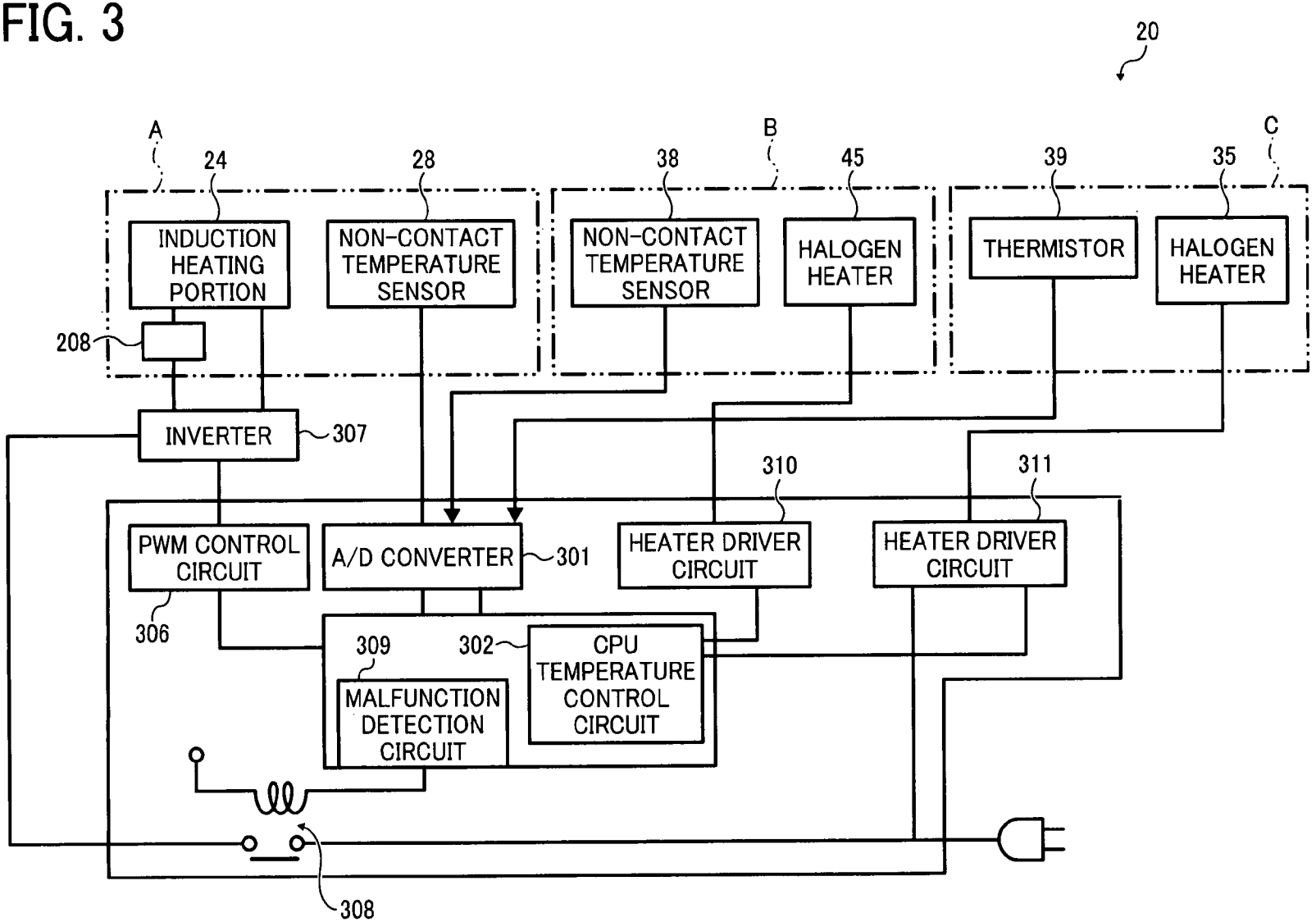
FIG. 3 is a circuit diagram (according to an example embodiment) of the fixing device shown in FIG. 2.

Referring to FIG. 3, the following describes a circuit configuration of the fixing device 20. FIG. 3 is a circuit diagram of the fixing device 20. The fixing device 20 further includes a heat generation control circuit A, an inverter 307, a relay circuit 308, a malfunction detection circuit 309, an A/D converter 301, a CPU (central processing unit) temperature control circuit 302, a PWM control circuit 306, an anti-temperature increase circuit 208, ON-OFF control circuits B and C, and/or heater driver circuits 310 and 311.

The heat generation control circuit A is provided for the heating roller 23 depicted in FIG. 2 and corresponds to the induction heating portion 24, the non-contact temperature sensor 28, and the anti-temperature increase circuit 208. The induction heating portion 24 is connected to the inverter 307. The relay circuit 308 breaks an alternating current from a commercial power source based on judgment of the malfunction detection circuit 309. The inverter 307 generates a high-frequency current for induction heating via the relay circuit 308. The A/D converter 301 converts a signal generated according to a temperature detected by the non-contact temperature sensor 28 provided in the heat generation control circuit A into a pulse signal by which the PWM control circuit 306 operates according to an operation command judged by the CPU temperature control circuit 302.

The high-frequency current generated by the inverter 307 is flown to the coil 25 depicted in FIG. 2 of the induction heating portion 24 via the anti-temperature increase circuit 208, such as a thermostat, to control heat generation of the heating roller 23.

The ON-OFF control circuit B is provided for the halogen heater 45 inside the tension roller 40 depicted in FIG. 2. The ON-OFF control circuit B inputs an alternating current from a commercial power source to the heater driver circuit 310. The heater driver circuit 310 controls turning on and off the halogen heater 45, including a case in which the halogen heater 45 malfunctions, with triac and relay according to a signal directly sent from the non-contact temperature sensor 38 and a signal judged by the CPU temperature control circuit 302.

The ON-OFF control circuit C is provided for the halogen heater 35 inside the pressing roller 30 depicted in FIG. 2. The ON-OFF control circuit C inputs an alternating current from a commercial power source to the heater driver circuit 311. The heater driver circuit 311 controls turning on and off the halogen heater 35, including a case in which the halogen heater 35 malfunctions, with triac and relay according to a signal directly sent from the thermistor 39 and a signal judged by the CPU temperature control circuit 302.

The image forming apparatus 1 depicted in FIG. 1 is manufactured to provide enhanced productivity at a high speed using a maximum electric power available in each country. Accordingly, the fixing device 20 is configured to provide enhanced productivity corresponding to each country. For example, when a maximum electric power consumption of 1,500 W is applied to the image forming apparatus 1 in Japan during an image forming operation, that is, when a sheet P is fed in the image forming apparatus 1, devices included in the image forming apparatus 1 other than the fixing device 20 use an electric power of 800 W and the fixing device 20 uses an electric power of 700 W. When a maximum electric power consumption of 1,920 W is applied to the image forming apparatus 1 in North America during an image forming operation, devices included in the image forming apparatus 1 other than the fixing device 20 use an electric power of 800 W and the fixing device 20 uses an electric power of 1,120 W. When a maximum electric power consumption of 2,400 W is applied to the image forming apparatus 1 in Europe during an image forming operation, devices included in the image forming apparatus 1 other than the fixing device 20 use an electric power of 800 W and the fixing device 20 uses an electric power of 1,600 W.

The electric power consumption (e.g., 1,600 W) of the fixing device 20 in Europe is about twice as large as the electric power consumption (e.g., 700 W) of the fixing device 20 in Japan. Generally, size of parts used for induction heating is proportional to the electric power consumption. Therefore, size of the inverter 307 and the induction heating portion 24 for Europe is about twice as large as size of the inverter 307 and the induction heating portion 24 for Japan. Consequently, the fixing device 20 for Europe is larger than the fixing device 20 for Japan.

When the image forming apparatus 1 is powered on, the devices included in the image forming apparatus 1 other than the fixing device 20 stop and power supply is concentrated on the fixing device 20. For example, when an electric power of 100 W is used to control the image forming apparatus 1, the fixing device 20 uses an electric power of 1,400 W in Japan, an electric power of 1,820 W in North America, and an electric power of 2,300 W in Europe. Accordingly, size of parts used for induction heating in Europe is about three times as large as size of parts used for induction heating in Japan.

To address this, for example, in the fixing device 20 for Japan, the halogen heater 45 uses an electric power of 700 W, which is obtained by subtracting an electric power of 700 W used by the fixing device 20 during an image forming operation from an electric power of 1,400 W used by the fixing device 20 when the image forming apparatus 1 is powered on. Thus, the halogen heater 45 provided inside the tension roller 40 uses an electric power of 700 W and the parts used for induction heating use an electric power of 700 W during an image forming operation.

In the fixing device 20 for Europe, two halogen heaters 45 are provided. The two halogen heaters 45 use an electric power of 1,600 W, which is obtained by subtracting an electric power of 700 W used by the fixing device 20 during an image forming operation in Japan from an electric power of 2,300 W used by the fixing device 20 when the image forming apparatus 1 is powered on in Europe. One of the two halogen heaters 45 uses an electric power of 900 W, which is obtained by subtracting an electric power of 700 W used by the fixing device 20 during an image forming operation in Japan from an electric power of 1,600 W used by the fixing device 20 during an image forming operation in Europe. In FIG. 3, one halogen heater 45 is used.

The halogen heater 35 provided inside the pressing roller 30 depicted in FIG. 2 may also use an electric power varying depending on location (e.g., country) in which the fixing device 20 is used. However, the pressing roller 30 includes a surface layer including a silicone rubber, providing decreased heat transfer efficiency to a sheet P. Therefore, it is effective to adjust the electric power used by the halogen heater 45 provided inside the tension roller 40 to provide heat transfer efficiency equivalent to heat transfer efficiency provided by induction heating.

Even when an electric power, which can be used by the fixing device 20 using induction heating, varies depending on location of the fixing device 20, a number of the halogen heater 45, serving as a secondary heat source for supplying a deficiency of heat when the induction heater 2, serving as a primary heat source or a main heat source, does not supply a sufficient amount of heat, is adjusted. Accordingly, the fixing device 20 can generate a sufficient amount of heat without changing the structure of the induction heater 2 or upsizing the induction heater 2. Namely, the induction heater 2 maintains a compact size.

Figure 4:
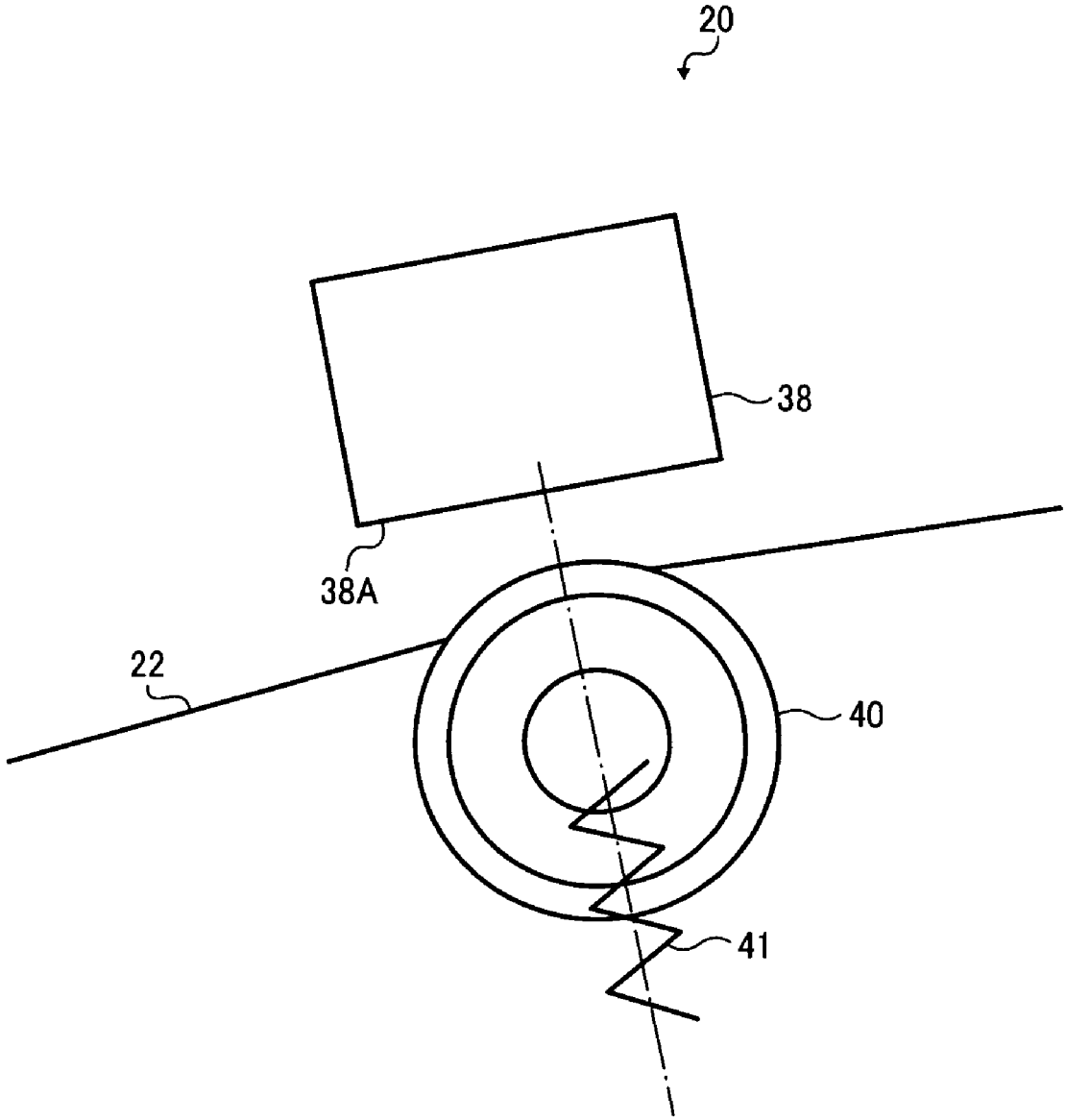
FIG. 4 is an enlarged sectional view (according to an example embodiment) of the fixing device shown in FIG. 2.

FIG. 4 is an enlarged sectional view of the fixing device 20. The fixing device 20 further includes a spring 41. The non-contact temperature sensor 38 includes a detection surface 38A.

The spring 41 pushes up a rotary shaft of the tension roller 40 to apply tension to the fixing belt 22 so as to prevent the fixing belt 22 from slacking.

As illustrated in FIG. 2, a silicone rubber or a sponge covers the fixing roller 21. When a plurality of sheets P is continuously conveyed through the fixing nip formed between the fixing belt 22 and the pressing roller 30, the fixing roller 21 is warmed and thermally expanded. Accordingly, the fixing belt 22 is stretched by an increased tension and pushes the tension roller 40 toward an inside of a loop formed by the fixing belt 22. In other words, the tension roller 40 moves against a load direction of the spring 41 serving as a force applier. However, movement of the tension roller 40 in several millimeters does not affect a temperature detection signal generated by the non-contact temperature sensor 38 substantially.

When the fixing belt 22 stops rotating and the non-contact temperature sensor 38 detects a temperature of an area on the fixing belt 22 in which a space is provided between the tension roller 40 and the fixing belt 22 due to deviation of an infrared optical path, the non-contact temperature sensor 38 may not detect the temperature properly. To address this, as illustrated in FIG. 4, the non-contact temperature sensor 38 is disposed in such a manner that the detection surface 38A of the non-contact temperature sensor 38 is perpendicular to a movement track of the tension roller 40. In other words, the detection surface 38A opposes a direction in which the spring 41 applies a force to the tension roller 40. Thus, the non-contact temperature sensor 38 can detect a temperature of the fixing belt 22 looped over the tension roller 40 properly. Consequently, the fixing belt 22 can be heated even when the fixing belt 22 stops rotating in a standby mode. Accordingly, when the fixing belt 22 starts rotating to feed a sheet P, the fixing belt 22 may not be cooled, resulting in stable temperature detection and improved reliability.

Figure 5:
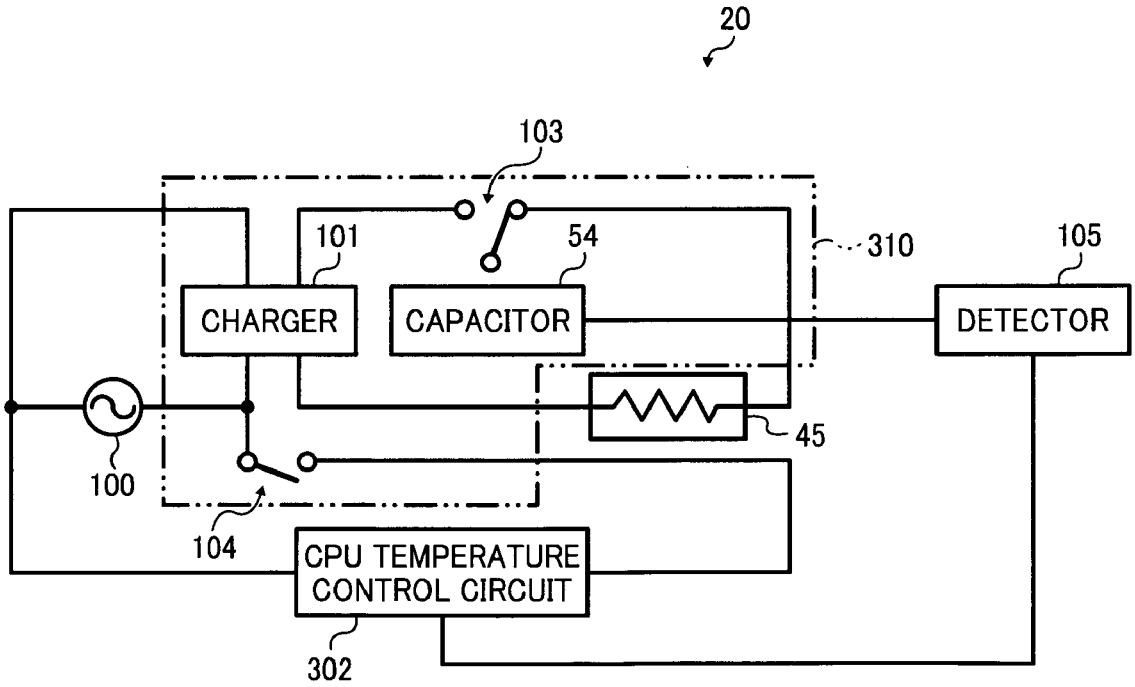
FIG. 5 is a circuit configuration (according to an example embodiment) of the fixing device shown in FIG. 2.

FIG. 5 is a circuit configuration of the fixing device 20 to supply a DC (direct current) power of a capacitor instead of an AC (alternating current) power of a commercial power source to the halogen heater 45 serving as a secondary heat source in the standby mode. The fixing device 20 further includes a capacitor 54, a commercial power source 100, a charger 101, switches 103 and 104, and/or a detector 105.

The charger 101 and the switch 104 of the heater driver circuit 310 connect the capacitor 54 to the commercial power source 100. The switch 103 connects the charger 101 to the capacitor 54 and the halogen heater 45 serving as an internal load. Information about a charge amount provided by the detector 105 is transmitted to the CPU temperature control circuit 302. When the information provided by the detector 105 indicates that the capacitor 54 is sufficiently charged, the CPU temperature control circuit 302 causes the capacitor 54 to supply power to the halogen heater 45 via the charger 101. When the information provided by the detector 105 indicates that the capacitor 54 is not sufficiently charged, the CPU temperature control circuit 302 causes the commercial power source 100 to charge the capacitor 54.

Even when the commercial power source 100 has a low voltage, the capacitor 54 provides power of a uniform watt. When the inverter 307 depicted in FIG. 3 performs high-frequency conversion, the induction heater 2 depicted in FIG. 2 provides power of a uniform watt regardless of voltage of the commercial power source 100. Accordingly, the halogen heater 45 provided inside the tension roller 40 depicted in FIG. 2 supplies heat to the fixing belt 22 depicted in FIG. 2 by using power stored in the capacitor 54 providing power of a uniform watt, so as to compensate a deficiency of heat provided by the induction heater 2. Namely, in the fixing device 20 using induction heating, the capacitor 54 can provide stable power used for fixing a toner image T on a sheet P in correspondence with change in voltage of the commercial power source 100. In this case, at least one of the halogen heaters 45 may serve as a DC halogen heater because the capacitor 54 outputs a direct current.

Figure 6:
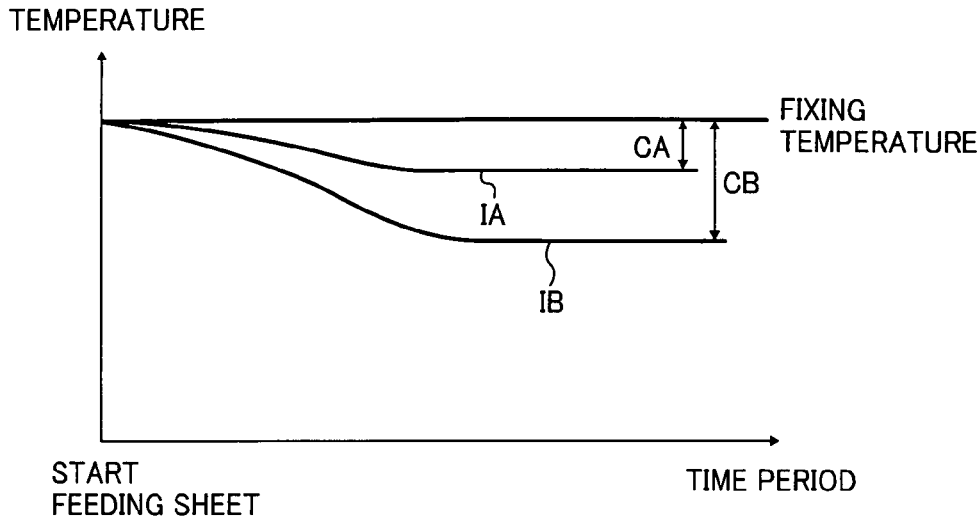
FIG. 6 is a graph (according to an example embodiment) illustrating a relation between a time period and a temperature when a capacitor included in the fixing device shown in FIG. 5 supplies power normally and when the capacitor supplies a decreased power to an induction heater included in the fixing device shown in FIG. 2.

FIG. 6 is a graph illustrating a relation between a time period and a temperature when the capacitor 54 (depicted in FIG. 5) supplies power normally and when the capacitor 54 supplies a decreased power to the induction heater 2 (depicted in FIG. 2).

The induction heater 2 depicted in FIG. 2 can output a uniform, high-frequency power regardless of voltage of the commercial power source 100 depicted in FIG. 5. However, units other than the induction heater 2 use a direct current and thereby output power of a uniform watt regardless of voltage of the commercial power source 100. Accordingly, when the commercial power source 100 outputs a low voltage, electric currents flowing in the entire fixing device 20 depicted in FIG. 2 may have a value exceeding a reference value. To address this, the induction heater 2, which uses more power than the other units do, may need to output a decreased power.

When the commercial power source 100 has a decreased voltage, the capacitor 54 stores power for an increased period of time and outputs power without constraints, such as an electric current. Therefore, power supply by the capacitor 54 to the halogen heater 45 depicted in FIG. 5 is turned on and off according to output of the inverter 307 depicted in FIG. 3 for generating a high-frequency current for induction heating. For example, when the induction heater 2 outputs a decreased power (e.g., heat) corresponding to an IH (induction heater) output IB depicted in FIG. 6, the capacitor 54 is controlled to increase output per unit of time. For example, as illustrated in FIG. 6, the capacitor 54 provides an increased capacitor supply CB to maintain a proper fixing temperature to fix a toner image T on a sheet P obtained by adding a normal capacitor supply CA to an IH (induction heater) output IA. Thus, using power stored in the capacitor 54 under a predetermined condition can improve reliability.

Figure 7:
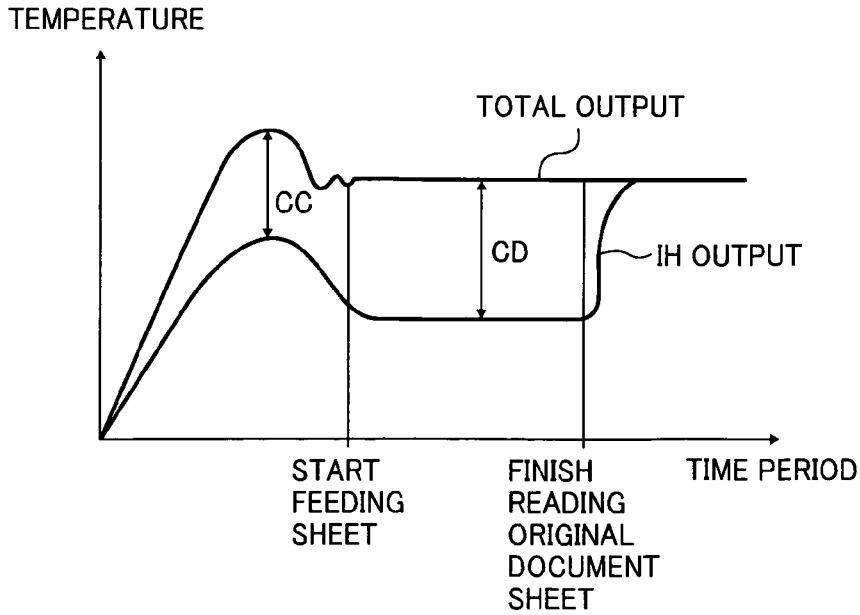
FIG. 7 is a graph (according to an example embodiment) illustrating a relation between a time period and a temperature when a capacitor included in the fixing device shown in FIG. 5 supplies power.

FIG. 7 is a graph illustrating a time period and a temperature when the capacitor 54 depicted in FIG. 5 supplies power. The capacitor 54 supplies power stored in the standby mode when the fixing device 20 depicted in FIG. 2 uses a small amount of power. In other words, the capacitor 54 needs to supply power to the halogen heater 45 depicted in FIG. 5 when the fixing device 20 is powered on or the fixing device 20 starts fixing a toner image T on a sheet P, that is, when the fixing device 20 uses a large amount of power to heat units included in the fixing device 20. To address this, the capacitor 54 supplies power (e.g., a capacitor supply CC) to the halogen heater 45 when the fixing device 20 is powered on. The capacitor 54 also supplies power (e.g., a capacitor supply CD) when the scanner 50 depicted in FIG. 1 continuously reads images on a maximum number of original document sheets readable for a single job.

When the ADF 10 depicted in FIG. 1 continuously feeds original document sheets to the scanner 50 so that the scanner 50 reads images on the original document sheets, a substantial amount of power is used to drive a feeding motor of the ADF 10 and a motor and a lamp of the scanner 50. However, after the scanner 50 finishes reading the images on the original document sheets, a substantial amount of power corresponding to the amount of power used to drive the feeding motor of the ADF 10 and the motor and the lamp of the scanner 50 can be supplied to the fixing device 20.

The capacitor 54 supplies power to the halogen heater 45 when the fixing device 20 is powered on and when the scanner 50 continuously reads images on a maximum number of original document sheets fed by the ADF 10 and readable for a single job by the scanner 50. Accordingly, the capacitor 54 outputs a decreased amount of power stored in the capacitor 54. Consequently, the capacitor 54 can finish storing power within a decreased time period. Even when a next job starts within a short time period after a previous job, the capacitor 54 can supply power to the halogen heater 45 properly. Thus, using power stored in the capacitor 54 under a predetermined condition can improve reliability.

Figure 8A:
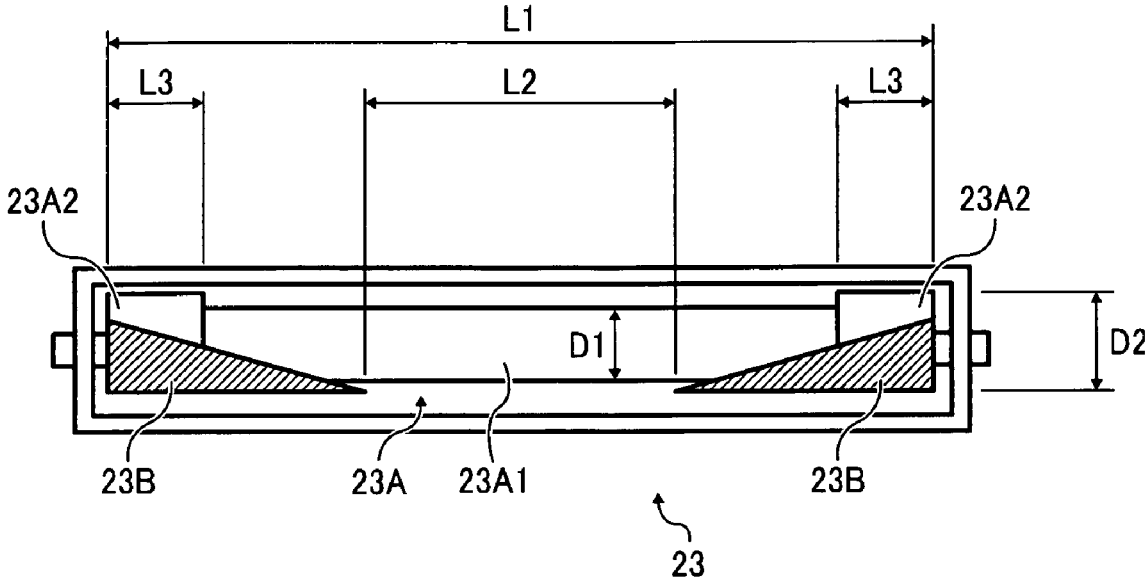
FIG. 8A is a side view (according to an example embodiment) of a heating roller included in the fixing device shown in FIG. 2 seen from an induction heater included in the fixing device.
Figure 8B:
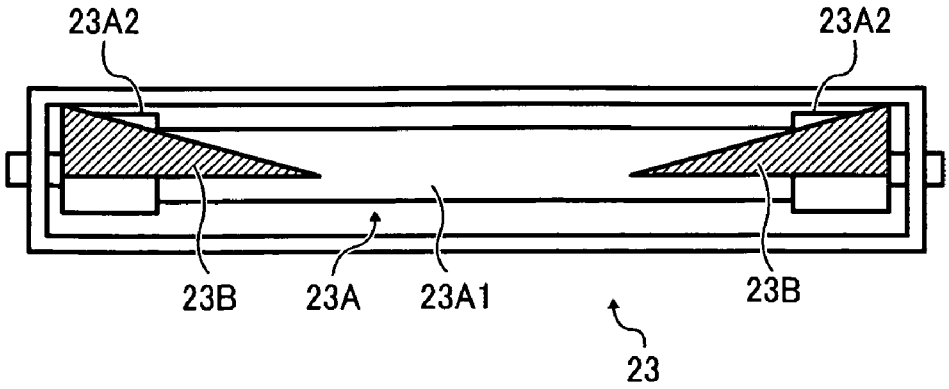
FIG. 8B is a side view (according to an example embodiment) of the heating roller shown in FIG. 8A when an internal core and shield members provided inside the heating roller are rotated by a reference angle from positions of the internal core and the shield members illustrated in FIG. 8A.

FIG. 8A is a side view of the heating roller 23 seen from the induction heating portion 24 depicted in FIG. 2. FIG. 8B is a side view of the heating roller 23 when the internal core 23A and the shield members 23B are rotated by a reference angle from positions of the internal core 23A and the shield members 23B illustrated in FIG. 8A. As illustrated in FIGS. 8A and 8B, the internal core 23A includes a small-diameter portion 23A1 and/or large-diameter portions 23A2.

As illustrated in FIG. 8A, the internal core 23A and the shield members 23B are rotatably provided inside the tubular heating roller 23. The cylindrical internal core 23A has a width L1. The small-diameter portion 23A1 of the internal core 23A is provided in a center of the axial direction of the heating roller 23. The large-diameter portions 23A2 of the internal core 23A are provided in both ends of the axial direction of the heating roller 23 within widths L3 from both edges of the internal core 23A in the axial direction of the heating roller 23, respectively. A diameter D2 of the large-diameter portions 23A2 is larger than a diameter D1 of the small-diameter portion 23A1. Alternatively, the internal core 23A may have a tubular shape.

The shield members 23B are integrally provided with the internal core 23A in both ends of the internal core 23A in the axial direction of the heating roller 23. The shield members 23B include shield areas for shielding an outer circumferential surface of the internal core 23A, which gradually decrease or increase from the both edges of the internal core 23A in the axial direction of the heating roller 23, respectively. Thus, when the internal core 23A rotates with the shield members 23B, shielded areas on the outer circumferential surface of the internal core 23A shielded by the shield members 23B, which oppose the coil 25 of the induction heating portion 24 depicted in FIG. 2, change in the axial direction of the heating roller 23. A stepping motor connected to a shaft of the internal core 23A drives and rotates the internal core 23A and the shield members 23B. The stepping motor for rotating the internal core 23A and the shield members 23B is different from a driving motor for driving the fixing roller 21, the fixing belt 22, and the heating roller 23.

The internal core 23A and the shield members 23B rotate by 90 degrees in a circumferential direction of the internal core 23A from the positions of the internal core 23A and the shield members 23B illustrated in FIG. 8A to positions of the internal core 23A and the shield members 23B illustrated in FIG. 8B, so that the shield members 23B shield largest areas on the outer circumferential surface of the internal core 23A, which oppose the induction heating portion 24, respectively. In the shielded areas, the shield members 23B block magnetic lines of force to be generated between the internal core 23A and the core 26 (depicted in FIG. 2) of the induction heating portion 24. Accordingly, portions of the fixing belt 22 corresponding to the shielded areas, respectively, are not heated easily. By contrast, a portion of the fixing belt 22 corresponding to a non-shielded area, that is, an area corresponding to a width L2 in a center of the internal core 23A in the axial direction of the heating roller 23, is heated.

The internal core 23A and the shield members 23B are positioned as illustrated in FIG. 8B to effectively fix toner images T on sheets P having the width L2 and continuously fed to the fixing nip formed between the fixing belt 22 and the pressing roller 30 depicted in FIG. 2. For example, in order to fix a toner image T on a sheet P having a smallest width (e.g., 148 mm) handled by the image forming apparatus 1 depicted in FIG. 1, the internal core 23A and the shield members 23B are fixed at the positions illustrated in FIG. 8B, and a fixing process described above by referring to FIG. 2 is performed.

The portion of the fixing belt 22 corresponding to the width L2 has a uniform temperature in the axial direction of the heating roller 23, providing improved fixing property for a toner image T on a sheet P having the width L2. The portions of the fixing belt 22 corresponding to areas outside the width L2, which are the shielded areas shielded by the shield members 23B, respectively, do not receive the magnetic lines of force because the shield members 23B block the magnetic lines of force. Accordingly, the portion of the fixing belt 22 corresponding to the width L2 is heated intensively to provide an increased amount of heat generated per unit width. Thus, the fixing device 20 depicted in FIG. 2 generates heat in correspondence to change in status of the fixing device 20, for example, the standby mode in which the fixing belt 22 does not rotate and a fixing mode in which the fixing belt 22 rotates to fix a toner image T on a sheet P, or in correspondence to change in temperature distribution caused when sheets P are continuously fed to the fixing belt 22. Consequently, the fixing device 20 can provide improved reliability.

Figure 9:
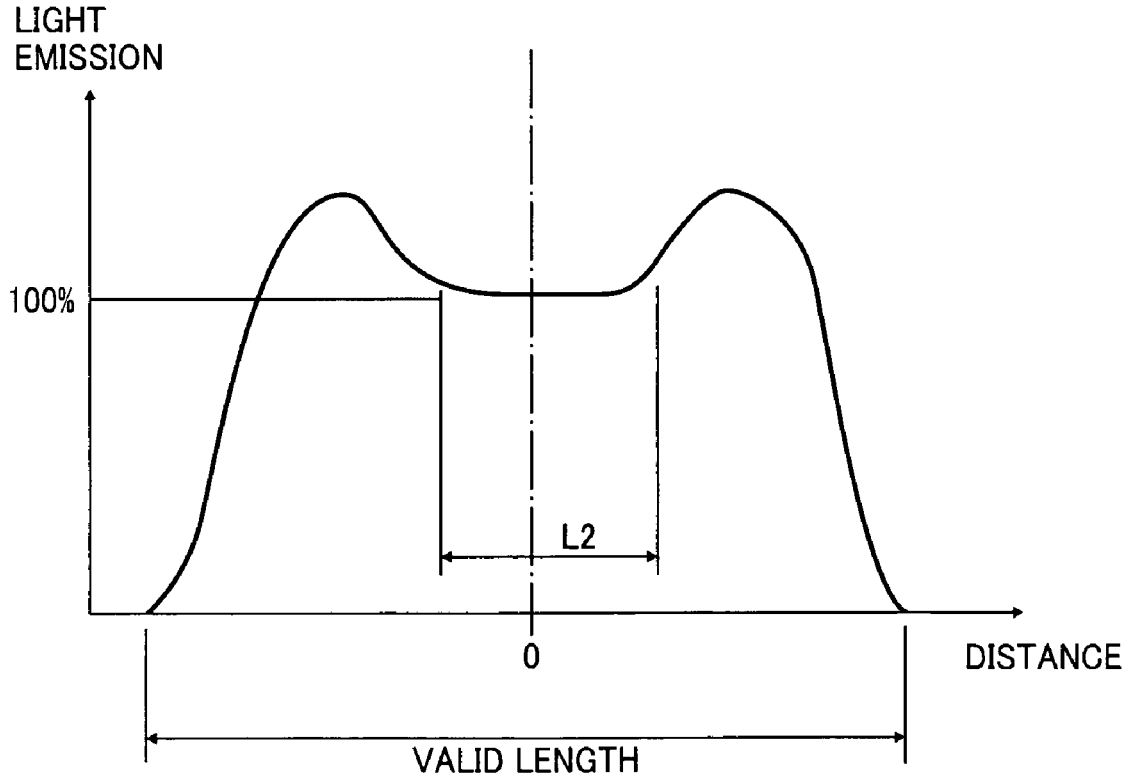
FIG. 9 is a graph (according to an example embodiment) illustrating a relation between a distance from a center of a halogen heater included in the fixing device shown in FIG. 2 in an axial direction of the halogen heater and light emission of the halogen heater.

FIG. 9 is a graph illustrating a relation between a distance from a center of the-halogen heater 45 depicted in FIG. 2 in an axial direction of the halogen heater 45 and light emission of the halogen heater 45. A heat generation rate of both ends of the halogen heater 45 in the axial direction of the halogen heater 45 is greater than a heat generation rate of the center of the halogen heater 45 in the axial direction of the halogen heater 45. A substantial amount of heat is used to heat the units included in the fixing device 20 depicted in FIG. 2 when the fixing device 20 is powered on and when the fixing device 20 starts feeding a sheet P toward the fixing nip formed between the fixing belt 22 and the pressing roller 30 depicted in FIG. 2. To address this, the capacitor 54 depicted in FIG. 5 supplies power stored in the capacitor 54 to the halogen heater 45. The halogen heater 45, serving as a heat source and having a roller shape, is provided inside the tension roller 40 and is rotatably supported at both ends of the halogen heater 45 in the axial direction of the halogen heater 45.

Therefore, in the standby mode in which the fixing belt 22 stops rotating, a temperature of the both ends of the halogen heater 45 in the axial direction of the halogen heater 45 is lower than a temperature of the center of the halogen heater 45 in the axial direction of the halogen heater 45. To address this, the both ends of the halogen heater 45 need to generate more heat than the center of the halogen heater 45 when the fixing device 20 is powered on and when the fixing device 20 starts feeding a sheet P. When the capacitor 54 supplies power to the halogen heater 45 provided inside the tension roller 40, more light is distributed to the both ends of the halogen heater 45 in the axial direction of the halogen heater 45 to provide stable temperature distribution. When more light is distributed to the both ends of the halogen heater 45 corresponding to the shielded areas shielded by the shield members 23B depicted in FIG. 8A than to the center of the halogen heater 45 corresponding to the non-shielded area not shielded by the shield members 23B and having the width L2 depicted in FIG. 8A, the induction heater 2 can adjust the temperature of the fixing belt 22 varied by the temperature increase of the both ends of the halogen heater 45. Thus, the fixing device 20 generates heat in correspondence to change in status of the fixing device 20, for example, the standby mode in which the fixing belt 22 does not rotate and the fixing mode in which the fixing belt 22 rotates to fix a toner image T on a sheet P, or in correspondence to change in temperature distribution caused when sheets P are continuously fed to the fixing belt 22. Consequently, the fixing device 20 can provide improved reliability.

In the fixing device 20 including the fixing belt 22, the internal core 23A and the shield members 23B are provided inside the heating roller 23, as illustrated in FIG. 8A. Therefore, the heating roller 23 does not directly receive pressure applied by the pressing roller 30. Accordingly, the heating roller 23 can have a thinner thickness than a fixing roller for which the induction heating portion 24 is provided, and thereby can have a smaller heat capacity. Consequently, the heating roller 23 can heat the fixing belt 22 quickly, providing improved response and performance.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A fixing device for fixing a toner image on a recording medium, comprising:

an endless fixing belt;

a fixing roller to support the fixing belt;

a heating roller to support the fixing belt together with the fixing roller;

a pressing roller to press against the fixing roller via the fixing belt to form a fixing nip between the fixing belt and the pressing roller;

a tension roller to press against the fixing belt to apply tension to the fixing belt;

a primary heat source to heat the fixing belt, disposed along an outer face of the fixing belt opposite the heating roller; and a secondary heat source provided inside the tension roller to supply deficient heat not provided by the primary heat source, wherein the tension roller having the secondary heat source is along an inner face of the fixing belt.

2. The fixing device according to claim 1, wherein the primary heat source is an induction heater comprising:

an induction heating portion to oppose the heating roller via the fixing belt and to extend in an axial direction of the heating roller; and a core provided inside the heating roller and opposite the induction heating portion.

3. The fixing device according to claim 2, wherein the induction heater further comprises a movable shield member to shield at least a part of the core, a position of the shield member being variable to vary the shielded part of the core.

4. The fixing device according to claim 1, further comprising:

a non-contact temperature sensor to control the secondary heat source, the non-contact temperature sensor comprising a detection surface opposing a direction in which the tension roller is pressed against the fixing belt.

5. The fixing device according to claim 1, further comprising:

a capacitor to store power to be supplied to the secondary heat source in a standby mode.

6. The fixing device according to claim 5, further comprising:

an inverter to output a high-frequency current to the primary heat source; and a controller to control the power supply from the capacitor to the secondary heat source based on the high-frequency current output from the inverter.

7. The fixing device according to claim 5, wherein the capacitor supplies power to the secondary heat source when the fixing device is powered on and when a plurality of original document sheets constituting a single job is read continuously.

8. The fixing device according to claim 1, wherein a heat generation rate at both ends of the secondary heat source in an axial direction of the secondary heat source is greater than a heat generation rate at a center of the secondary heat source in the axial direction of the secondary heat source.

9. The fixing device according to claim 1, wherein the heating roller includes an internal core and shield members inside thereof.

10. The fixing device according to claim 9, wherein the internal core opposes a coil of the primary heat source via the fixing belt.

11. The fixing device according to claim 9, wherein the shield members shield both ends of the internal core in an axial direction of the heating roller.

12. The fixing device according to claim 11, wherein the internal core rotates simultaneously with the shield members.

13. The fixing device according to claim 11, wherein the internal core and the shield members do not rotate simultaneously with the heating roller.

14. The fixing device according to claim 1, further comprising a non-contact temperature sensor opposite the tension roller to detect a temperature of the tension roller via the fixing belt.

15. The fixing device according to claim 14, wherein the secondary heat source is turned on and off according to the detected temperature of the tension roller.

16. The fixing device according to claim 1, wherein the pressing roller includes a tertiary heat source therein.

17. The fixing device according to claim 16, further comprising a temperature sensor which opposes an outer surface of the pressing roller and detects a temperature of the pressing roller.

18. The fixing device according to claim 17, further comprising an oil applicator roller which contacts the outer circumferential surface of the pressing roller to apply oil to the pressing roller.

19. An image forming apparatus, comprising:

an image forming mechanism to form a toner image on a recording medium; and a fixing device to fix the toner image on the recording medium, the fixing device including:

an endless fixing belt;

a fixing roller to support the fixing belt;

a heating roller to support the fixing belt together with the fixing roller;

a pressing roller to press against the fixing roller via the fixing belt to form a fixing nip between the fixing belt and the pressing roller;

a tension roller to press against the fixing belt to apply tension to the fixing belt;

a primary heat source to heat the fixing belt, disposed along an outer face of the fixing belt opposite the heating roller; and a secondary heat source provided inside the tension roller to supply deficient heat not provided by the primary heat source, wherein the tension roller having the secondary heat source is along an inner face of the fixing belt.

20. The image forming apparatus according to claim 19, wherein the primary heat source is an induction heater comprising:

an induction heating portion to oppose the heating roller via the fixing belt and to extend in an axial direction of the heating roller; and a core provided inside the heating roller and opposite the induction heating portion.

* * * * *